US006553200B2

(12) United States Patent
Hiraoka et al.

(10) Patent No.: US 6,553,200 B2
(45) Date of Patent: Apr. 22, 2003

(54) LIQUID ELECTROPHOTOGRAPHIC DEVELOPING APPARATUS USING ELECTRODES TO CHARGE TONER PARTICLES

(75) Inventors: Yuji Hiraoka, Tokorozawa (JP); Daisuke Hiraoka, Tokorozawa (JP)

(73) Assignee: Aetas Technology Incorporated, Irvine, CA (US)

( * ) Notice: Subject to any disclaimer, the term of this patent is extended or adjusted under 35 U.S.C. 154(b) by 0 days.

(21) Appl. No.: 09/812,950

(22) Filed: Mar. 27, 2001

(65) Prior Publication Data

US 2002/0064398 A1 May 30, 2002

Related U.S. Application Data

(63) Continuation-in-part of application No. 09/722,940, filed on Nov. 27, 2000, now abandoned.

(51) Int. Cl.[7] ..... G03G 15/10
(52) U.S. Cl. ..... 399/249
(58) Field of Search ..... 399/233, 237, 399/241, 246, 247, 242, 243, 249

(56) References Cited

U.S. PATENT DOCUMENTS 3,176,653 A * 4/1965 Hansen ..... 399/241
3,196,832 A * 7/1965 Zin ..... 399/247 X
3,484,162 A * 12/1969 Clark ..... 399/241
3,507,252 A * 4/1970 Leedom ..... 399/241
5,017,968 A * 5/1991 Oikawa ..... 399/241
5,231,455 A * 7/1993 Day ..... 399/233 X
5,689,761 A * 11/1997 Denton et al. ..... 399/233 X
5,899,605 A * 5/1999 Caruthers et al. ..... 399/233 X
6,070,034 A * 5/2000 Hiraoka et al. ..... 399/233 X

* cited by examiner

*Primary Examiner*—Fred L Braun
(74) *Attorney, Agent, or Firm*—Sonnenschein Nath & Rosenthal

(57) ABSTRACT

A liquid electrophotographic developing apparatus including a developing unit and a plurality of air transport members. The developing unit has an elongated opening disposed adjacent to a moving image-bearing surface of a photoreceptor, and it is used for converting an electrostatic latent image into a toner image. Electrodes formed within the elongated opening provide an electric field to charge toner particles in a liquid developer. The air transport members are provided around the elongated opening of the developing unit, and airflow therein has a predetermined air pressure to transport unused developer away from the image-bearing surface while permitting toner particles in the liquid developer deposited on the image-bearing surface to be retained by the image-bearing surface.

10 Claims, 3 Drawing Sheets

LIQUID ELECTROPHOTOGRAPHIC DEVELOPING APPARATUS USING ELECTRODES TO CHARGE TONER PARTICLES

RELATED APPLICATION

This is a continuation-in-part of U.S. patent application Ser. No. 09/722,940, filed Nov. 27, 2000 now ABN.

FIELD OF THE INVENTION

The present invention relates to an electrophotographic developing apparatus for a copier or a printer, and more particularly, to a liquid electrophotographic developing apparatus in which leakage of liquid developers is prevented.

BACKGROUND OF THE INVENTION

Conventional liquid electrophotographic developing apparatuses bring a liquid developer into contact with an electrostatic latent image to be developed in any of several different ways. According to one method, the surface of a photoreceptor or other member carrying an electrostatic latent image is merely dipped into a bath of a liquid developer to develop the electrostatic latent image.

In another method, such as described in U.S. Pat. No. 5,017,968, a liquid developer is supplied to a head which extends across the width of a member bearing an electrostatic latent image and the liquid developer is supplied through one channel in the head to a slot opening where the liquid developer is brought into contact with the surface of the image-bearing member. The liquid developer is then withdrawn from the slot opening through another channel in the developing head.

In a further liquid developing arrangement, as shown in U.S. Pat. No. 5,708,937, a rotating cylinder is coated with a liquid developer at a supply point and carries the developer into contact with the image-bearing member to develop the image. Other apparatuses for supplying a liquid developer to an image-bearing member through a slot extending across the width of the member are discloses in U.S. Pat. Nos. 5,708,936, 5,737,672 and 5,765,078.

Such apparatuses for supplying a liquid developer to an image-bearing member have certain disadvantages including generation of odors resulting from vaporization of the liquid developer within the region of the developing unit, difficulties in reproducing colored images with successive developers of different colors in a single pass of the image-bearing member, and excessive size and cost of the developing units.

On the other hand, U.S. Pat. Nos. 5,358,659, 5,567,564 and 5,667,716 disclose methods of preparing magnetic liquid developers while U.S. Pat. No. 4,797,013 discloses the use of ferrofluids retained by magnets in gaps between moving members to seal lubricants in bearing arrangements. U.S. Pat. No. 4,645,960 discloses a ferrofluid bearing. U.S. Pat. No. 5,461,466 discloses a dripless seal for a liquid toner cartridge by which the cartridge is closed when not in use.

SUMMARY OF THE INVENTION

An object of the present invention is to set forth a liquid developing apparatus of electrostatic latent images that overcomes disadvantages of the prior art.

Another object of the present invention is to provide a liquid developing apparatus that minimizes emission of vapor from a liquid developer into the surrounding atmosphere.

An additional object of the present invention is to provide a compact and inexpensive liquid developing apparatus.

According to one aspect of the present invention, a liquid developing apparatus comprises:

a plurality of air transport members, provided around the elongated opening of the developing unit, containing air flow therein having a predetermined air pressure to transport unused liquid developer away from the image-bearing surface while permitting toner particles in the liquid developer deposited on the image-bearing surface to be retained by the image-bearing surface thereby converting an electrostatic latent image into a toner image.

According to another aspect of the present invention, a liquid developing apparatus comprises:

a plurality of developing units, each having electrodes formed within an elongated opening disposed adjacent to a moving image-bearing surface which provides liquid developer through an electric field onto the image-bearing surface of a photoreceptor which passes adjacent to the plurality of developing units in succession, for converting an electrostatic latent image into a toner image, each of the plurality of developing units containing a liquid developer of a different color; and a plurality of air transport members, each provided around the elongated opening of the developing unit, containing air flow therein having a predetermined air pressure, to transport unused liquid developer away from the image-bearing surface while depositing toner particles on an electrostatic latent image on the image-bearing surface of the photoreceptor as the photoreceptor moves adjacent to the elongated opening.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION

Figure 1:
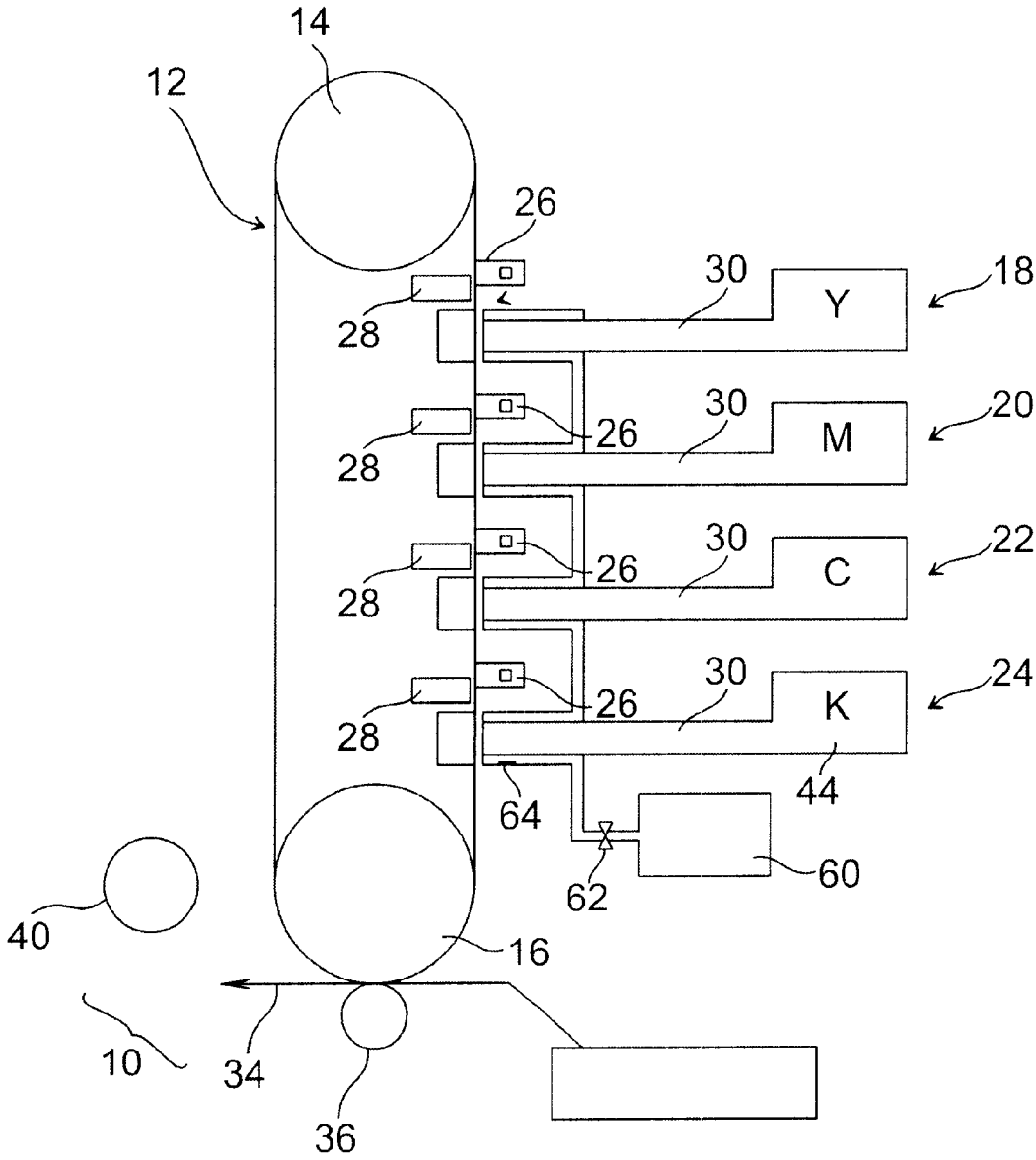
FIG. 1 is a view of an electrophotographic system having four liquid developing apparatuses according to an embodiment of the present invention.
Figure 2:
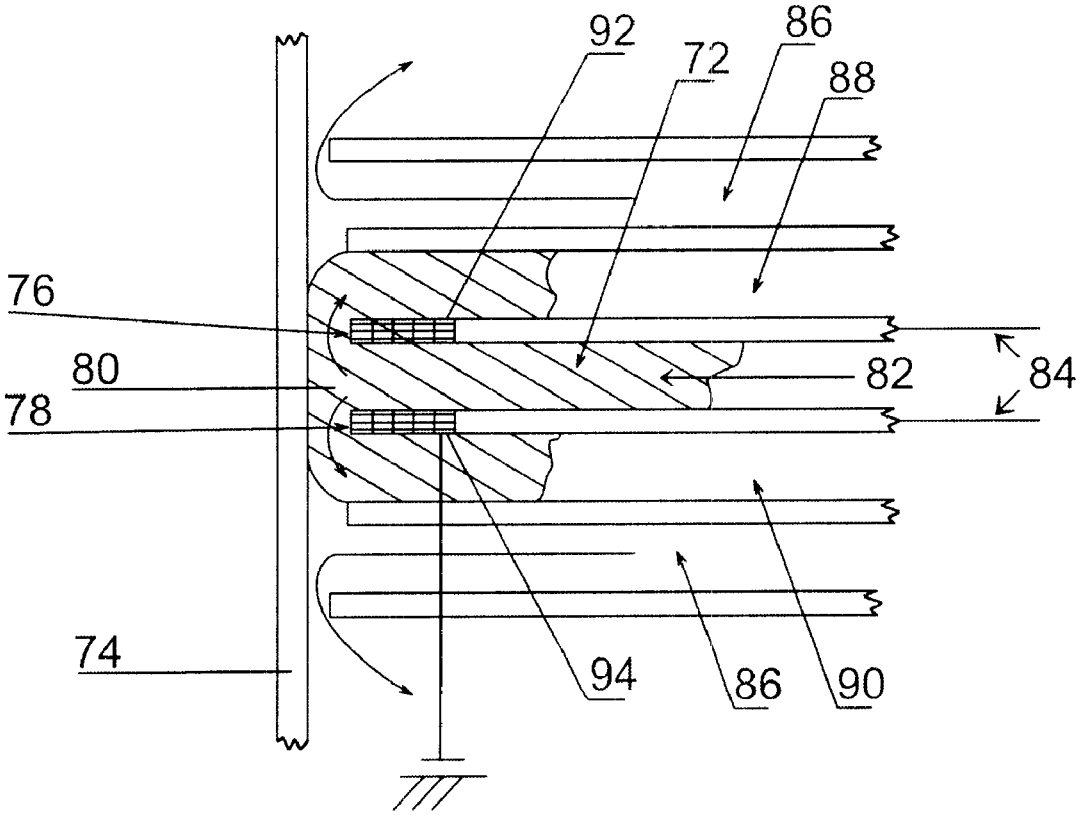
FIG. 2 is a view of an liquid developing apparatus according to an embodiment of the present invention.
Figure 3:
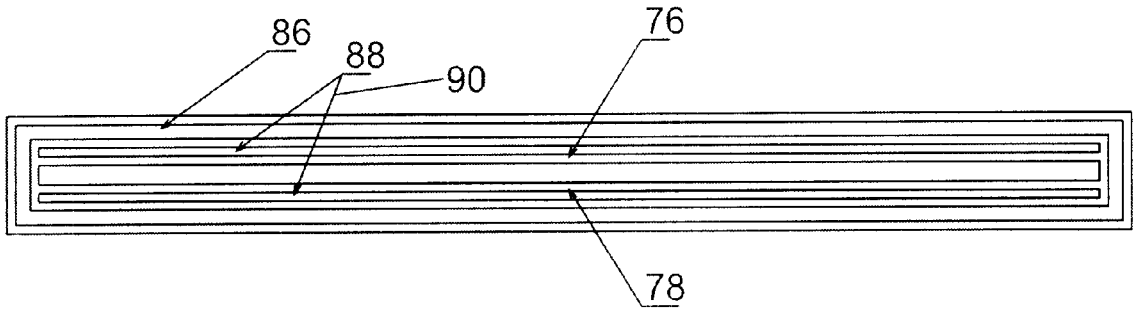
FIG. 3 is a plan view showing an elongated developing head of the liquid developing apparatus in FIG. 2.

In a preferred embodiment of the present invention illustrated in FIGS. 1–3, FIG. 1 is an electrophotographic system 10, which includes a belt-type photoreceptor 12, conveyed in the direction of the arrows in an endless loop around two spaced rollers 14 and 16. In order to produce a multicolor image, four printing stations 18, 20, 22 and 24 are disposed adjacent to the photoreceptor along a straight path of the photoreceptor belt. Each printing station includes a charging unit 26, an exposing unit 28 and a developing unit 30 and all of the printing stations are identical except that the four developing units 30 contain different colored liquid developers, for example, yellow (Y), magenta (M), cyan (C) and black (K).

As the photoreceptor 12 is driven past each printing station in its path, it is first charged by the charging unit 26 and then exposed by the exposure unit 28 to produce an electrostatic latent image appropriate for the particular color to be applied by that printing station and the image is then developed by the developing unit 30 with the correspondingly colored liquid developer. After all of the colored images have been printed, a medium 34 such as paper sheet or transparency is brought into contact with the surface bearing the colored image at a transfer station 36 so that the colored image is transferred to the medium 34 and the surface of the photoreceptor is thereafter cleaned at a cleaning station 40 in preparation for formation of the next colored image.

Furthermore, as shown in FIGS. 2 and 3, the developing unit 30 may have two or more electrodes 92 and 94 formed within the narrow gap 80 that is defined by parallel plates 76 and 78, such that the electrodes 92 and 94 form an electric field within the narrow gap 80. An electrostatic charge is applied by the electrodes 92 and 94 to charge the toner particles in the liquid developer 72 when the liquid developer 72 passes through the electric field generated by the electrodes 92 and 94. The charge must be strong enough so that the toner particles are retained on the surface of the photoreceptor by the electrostatic charges in the image. Such control of the polarity and magnitude of the charge on the toner particles can be effected in to those skilled in the art, and the details thereof are omitted.

In order to ensure a continuous supply of toner particles to the photoreceptor surface, the liquid developer 72 may be circulated from the liquid developer reservoir 44 to the photoreceptor surface by a conventional pumping arrangement.

Furthermore, an electrostatic charge is applied by the electrodes 92 and 94 to charge the toner particles in the liquid developer 72. The charge must be strong enough so that the toner particles are retained on the surface of the photoreceptor by the electrostatic charges in the image. Such control of the polarity and magnitude of the charge on the toner particles can be effected in conventional ways known to those skilled in the art, and the details thereof are omitted.

With the apparatus described in FIG. 2, the developing units 18, 20, 22 and 24 can be both compact and inexpensive to manufacture. Moreover, the developing apparatus of the present invention permits highly efficient one-pass multicolor processing because the adhering force between the toner particles and the electrostatic latent image can be controlled so as to be strong enough to overcome any tendency of the toner particles to be dislodged from the photoreceptor by the motion of the photoreceptor surface.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A liquid electrophotographic developing apparatus, comprising:

a developing unit, having electrodes formed within an elongated opening, the developing unit being disposed adjacent to a moving image-bearing surface of a photoreceptor, for providing liquid developer through an electric field generated by the electrodes onto the image-bearing surface converting an electrostatic latent image into a toner image; and a plurality of air transport members, provided around the elongated opening of the developing unit, containing air flow therein having a predetermined air pressure to transport unused liquid developer away from the image-bearing surface while permitting toner particles in the liquid developer electromagnetically attracted to the image-bearing surface to be retained by the image-bearing surface.

2. The liquid electrophotographic developing apparatus of claim 1, wherein the plurality of air transport members are provided with an air pressure control means for maintaining the air flow at a predetermined pressure.

3. The liquid electrophotographic developing apparatus of claim 2, wherein the air pressure control means comprises an air pressure sensor and a flow control valve.

4. The liquid electrophotographic developing apparatus of claim 1, wherein the electrodes apply an electrostatic charge to the toner particles.

5. The liquid electrophotographic developing apparatus of claim 4, wherein the electrostatic charge applied to the toner particles is of an opposite charge than the electrostatic latent image on the moving image-bearing surface.

6. A liquid electrophotographic developing apparatus, comprising:

a plurality of developing units, each having electrodes formed within an elongated opening, each of the plurality of developing units being disposed adjacent to a moving image-bearing surface which provides liquid developer through an electric field generated by the respective electrodes of the developing unit onto the image-bearing surface of a photoreceptor which passes adjacent to the plurality of developing units in succession, for converting an electrostatic latent image into a toner image; each of the plurality of developing units containing a liquid developer of a different color; and a plurality of air transport members, provided around the elongated opening of each of the developing units, the air transport members containing air flow therein having a predetermined air pressure to transport unused liquid developer away from the image-bearing surface while permitting toner particles in the liquid developer electromagnetically attracted to the image-bearing surface to be retained by the image-bearing surface.

7. The liquid electrophotographic developing apparatus of claim 6, wherein plurality of air transport members are provided with an air pressure control means for maintaining the air flow at a predetermined pressure.

8. The liquid electrophotographic developing apparatus of claim 7, wherein the air pressure control means comprises an air pressure sensor and a flow control valve.

9. The liquid electrophotographic developing apparatus of claim 6, wherein the electrodes apply an electrostatic charge to the toner particles.

10. The liquid electrophotographic developing apparatus of claim 9, wherein the electrostatic charge applied to the toner particles is of an opposite charge than the electrostatic latent image on the moving image-bearing surface.

* * * * *

UNITED STATES PATENT AND TRADEMARK OFFICE

CERTIFICATE OF CORRECTION

PATENT NO. : 6,553,200 B2
DATED : April 22, 2003
INVENTOR(S) : Yuji Hiraoka and Daisuke Hiraoka It is certified that error appears in the above-identified patent and that said Letters Patent is hereby corrected as shown below:

Title page,
Item [63], "Continuation-in-part of application No. 09/722,940, filed on Nov. 27, 2000, now abandoned" should read -- Continuation -in application No. 09/722,940 filed on Nov. 27, 2000 --

Signed and Sealed this

Twenty-seventh Day of April, 2004

JON W. DUDAS
*Acting Director of the United States Patent and Trademark Office*